US009950901B2

(12) United States Patent
Björni et al.

(10) Patent No.: US 9,950,901 B2
(45) Date of Patent: Apr. 24, 2018

(54) ELEVATOR ARRANGEMENT AND METHOD FOR RE-ADJUSTING THE ELEVATOR ARRANGEMENT

(71) Applicant: KONE CORPORATION, Helsinki (FI)

(72) Inventors: Osmo Björni, Hyvinkää (FI); Ari Hänninen, Hyvinkää (FI); Johannes De Jong, Järvenpää (FI); Pentti Alasentie, Espoo (FI); Matti Räsänen, Hyvinkää (FI); Timo Mertanen, Helsinki (FI); Santeri Suoranta, Espoo (FI); Antti Plathin, Vantaa (FI); Antti Kallioniemi, Jokela (FI)

(73) Assignee: KONE CORPORATION, Helsinki (FI)

( * ) Notice: Subject to any disclaimer, the term of this patent is extended or adjusted under 35 U.S.C. 154(b) by 982 days.

(21) Appl. No.: 14/307,135

(22) Filed: Jun. 17, 2014

(65) Prior Publication Data

US 2014/0291074 A1 Oct. 2, 2014

Related U.S. Application Data

(63) Continuation of application No. PCT/FI2012/051247, filed on Dec. 14, 2012.

(30) Foreign Application Priority Data

Jan. 2, 2012 (FI) ..... 20125001

(51) Int. Cl.
*B66B 9/00* (2006.01)
*B66B 19/00* (2006.01)
(Continued)

(52) U.S. Cl.
CPC ..... *B66B 9/00* (2013.01); *B66B 11/0005* (2013.01); *B66B 11/0095* (2013.01); *B66B 2201/305* (2013.01); *B66B 2201/307* (2013.01)

(58) Field of Classification Search
CPC ..... B66B 9/00; B66B 2201/306–2201/307; B66B 11/0005; B66B 11/0095
See application file for complete search history.

(56) References Cited

U.S. PATENT DOCUMENTS 3,750,849 A 8/1973 Berkovitz
2002/0084148 A1 7/2002 Nygren
(Continued)

FOREIGN PATENT DOCUMENTS

JP 2003-182951 A 7/2003
JP 2006-103887 A 4/2006
(Continued)

OTHER PUBLICATIONS

AIPN Machine Translation, JP 2006-168931 A, Jul. 10, 2017, pp. 1-23.*

*Primary Examiner* — William A. Rivera
*Assistant Examiner* — Stefan Kruer
(74) *Attorney, Agent, or Firm* — Birch, Stewart, Kolasch & Birch, LLP

(57) ABSTRACT

An elevator arrangement includes a plurality of elevators in a building, which plurality includes a plurality of zoned elevators moving in an elevator hoistway, which have different ranges of movement of the elevator car in the building to each other, and which zoned elevators each have a top limit and a bottom limit of the range of movement of the elevator car, to above the top limit and to below the bottom limit of which range of movement travel of the elevator car of the zoned elevator in question is prevented. The vertical location, in relation to the building, of the top limit and/or bottom limit of the range of movement of the elevator car of each aforementioned zoned elevator can be changed. The arrangement also comprises a lobby elevator, the range of movement of the elevator car of which differs from the ranges of movement of the elevator cars of the aforemen-
(Continued)

tioned zoned elevators, and the stopping floors of the lobby elevator comprise a plurality of lobby floors, each of which is a stopping floor of one or more zoned elevators belonging to the aforementioned zoned elevator plurality. A method is provided for re-adjusting the elevator arrangement, wherein the range of movement of the elevator car of the zoned elevator in question is changed to reach to a different height in the elevator hoistway by changing the vertical location in relation to the building of the top limit and/or the bottom limit of the range of movement of the elevator car of the zoned elevator in question.

17 Claims, 4 Drawing Sheets

(51) Int. Cl.

| | |
|---|---|
| ***B66B 11/00*** | (2006.01) |
| *B66B 11/08* | (2006.01) |
| *B66B 5/24* | (2006.01) |

(56) References Cited

U.S. PATENT DOCUMENTS

| | | | |
|---|---|---|---|
| 2005/0077115 | A1 | 4/2005 | Urata |
| 2008/0149428 | A1 | 6/2008 | Kocher et al. |
| 2010/0018809 | A1 | 1/2010 | Peacock et al. |

FOREIGN PATENT DOCUMENTS

| | | | |
|---|---|---|---|
| JP | 2006-168931 | A | 6/2006 |
| WO | WO 03/037771 | A1 | 5/2003 |
| WO | WO 03/101874 | A1 | 12/2003 |
| WO | WO 2004/071923 | A1 | 8/2004 |
| WO | WO 2011/148032 | A1 | 12/2011 |

* cited by examiner

ELEVATOR ARRANGEMENT AND METHOD FOR RE-ADJUSTING THE ELEVATOR ARRANGEMENT

CROSS REFERENCE TO RELATED APPLICATIONS

This application is a Continuation of PCT International Application No. PCT/FI2012/051247 filed on Dec. 14, 2012, which claims priority under 35 U.S.C. § 119(a) to Patent Application No. 20125001 filed in Finland on Jan. 2, 2012, all of which are hereby expressly incorporated by reference into the present application.

FIELD OF THE INVENTION

The object of the invention is an elevator arrangement and a method for re-adjusting the elevator arrangement, which elevator arrangement is preferably an elevator arrangement applicable to passenger transport and/or freight transport, comprising a plurality of elevators suited to this purpose.

BACKGROUND OF THE INVENTION

The invention relates to an elevator arrangement for high-rise buildings, which arrangement comprises a number of elevators, which have different ranges of movement in the vertical direction, and they therefore travel in the vertical direction to different heights, and can thus serve different floors. These elevators are in this context called zoned elevators. For feeding passengers to these types of elevators, there can also be a feeder elevator in use, which in this context is called a lobby elevator. A lobby elevator can efficiently feed passengers to the aforementioned zoned elevators, stopping only at some of the floors of the zoned elevators (in this context so-called "lobby floors"), from which lobby floors the passengers can continue to their destination floors with zoned elevators, which stop frequently. There are also other feeder methods. For example, when the arrangement is implemented without a separate feeder elevator, a passenger can climb to higher in the building using a number of zoned elevators consecutively. This, however, is an extremely slow elevator arrangement that is problematic from the viewpoint of peak traffic periods. In elevator arrangements according to prior art that comprise a number of elevators, one problem is that the construction phase decisions of the building developer and the decisions made on the basis of the needs of initial users concerning the layout of the elevators of the elevator arrangement are often not optimal from the viewpoint of later users of the building. If the owner/tenant of the premises of the building, or the intended usage of the building, later changes, the user traffic can change. Likewise, if the vertical size or user volume of company premises changes, a need can arise to transport people between such floors that originally had no elevator connection. User traffic can also change for other reasons. The service lives of buildings are long, and in practice an elevator arrangement is changed only when an old elevator is modernized and a new elevator arrangement with new elevators is installed. It has been uneconomic to use a building and its elevator arrangement for a long time in a manner that is clearly non-optimal. Taking the preceding into account, there is a need for a more flexible elevator arrangement than before.

Yet another problem noticed in elevators according to prior art is that the machine rooms of elevators have been formed to be large, and the bottom limit of the range of movement of the upper elevator of consecutive zoned elevators operating one above another has been at a distance from the top limit of the range of movement of the lower elevator. These reasons have resulted in the space usage of a building having an efficiency that could be improved with respect to an elevator arrangement. From the viewpoint of design freedom, it has been detrimental that the need to serve some floor has necessitated adjusting a zoned elevator system in a zigzag fashion alternately in adjacent hoistways.

GENERAL DESCRIPTION OF THE INVENTION

The aim of the invention is to produce an elevator arrangement that is more flexible than earlier and also a method for re-adjusting the elevator arrangement. The aim of the invention is further to solve the aforementioned problems of prior-art solutions as well as the problems disclosed in the description of the invention below. A further aim is to achieve a flexible elevator arrangement safely. A further aim is to achieve a flexible elevator arrangement, the re-adjustment of which can be performed quickly.

According to the invention the elevator arrangement comprises a plurality of elevators in a building, which plurality comprises a plurality of zoned elevators moving in an elevator hoistway, which have different ranges of movement of the elevator car in the building to each other, and which zoned elevators each have a top limit and a bottom limit of the range of movement of the elevator car, to above the top limit and to below the bottom limit of which range of movement travel of the elevator car of the zoned elevator in question is prevented. The vertical location, in relation to the building, of the top limit and/or bottom limit of the range of movement of the elevator car of each aforementioned zoned elevator can be changed. In this way a flexible elevator arrangement is achieved, which can be adapted after the actual commissioning to be optimal with regard to changing needs.

Preferably the zoned elevators each have a top limit and a bottom limit of the range of movement of the elevator car, to above the top limit and to below the bottom limit of which range of movement travel of the elevator car of the zoned elevator in question is mechanically prevented. In this way the solution is safe and simple to implement.

Preferably each zoned elevator comprises vertically movable support structures detachably supported in their position in the elevator hoistway, the vertical location of which in the elevator hoistway determines the location of the top limit/bottom limit of the range of movement of the elevator car of the zoned elevator in question.

Preferably the aforementioned support structures are detachably supported in their position in the elevator hoistway on mounting structures functioning as a support base, above and/or below which mounting structures are corresponding mounting structures such that the support structures detachably supported in their position can be detached from their mounting structures and displaced in the vertical direction and fixed again at a different height in the elevator hoistway to the aforementioned mounting structures above or below. In this way there is no need to perform a lot, or any, modifications to the mounting structures for the purpose of re-supporting, in which case re-supporting is quick to perform. Fixing for the purpose of re-supporting can be performed with the same detachable means t, with which the support structure was supported in its position in its earlier location. The solution is also flexible, because the location of the re-supporting can be selected freely.

Preferably the aforementioned support structures comprise means (t), with which the aforementioned support structures are detachably supported in their position on mounting structures, which comprise structures of the elevator hoistway itself or structures (such as guide rails) in the elevator hoistway, and that above and/or below the aforementioned mounting structures are corresponding mounting structures such that the support structures detachably supported in their position can be detached by opening the means (t) and displaced and fixed again at a different height in the elevator hoistway to the aforementioned mounting structures above or below.

Preferably the means (t), with which the aforementioned support structures are detachably supported in their position on mounting structures, are openable/closable means, which can be shifted between an open position and a closed position. Preferably the means (t) are compression means, which in the closed position compress the mounting structures from two sides, and which in the open position do not compress the mounting structures from two sides. Preferably the means t comprise wedging means for achieving compression, with which the body of the means (t) can be supported with the wedge principle directly on the mounting structures, preferably on a guide rail. This type of structure is safe. With it dependable stopping of the elevator car, if the elevator car drives towards the support structures in question, can also be achieved. It is further advantageous to fit a buffer between the elevator car and the support structure for this type of collision.

Preferably the elevator arrangement also comprises a lobby elevator, the range of movement of the elevator car of which differs from the ranges of movement of the elevator cars of the aforementioned zoned elevators, and the stopping floors of which lobby elevator comprise a plurality of lobby floors, each of which is a stopping floor of one or more zoned elevators belonging to the aforementioned zoned elevator plurality. With a lobby elevator feeder traffic can be offered to the zoned elevators and smooth transfer from the departure floor of the lobby elevator can be achieved, such as from the entrance lobby or sky lobby of the building, to the zoned elevators and onwards to the destination floor.

Preferably the range of movement and the stopping floors of a lobby elevator differ from the ranges of movement and the stopping floors of the aforementioned zoned elevators such that each zoned elevator has one or more stopping floors, which is not a stopping floor of a lobby elevator. In this way the feeder traffic to the zoned elevators is fast and onward passage from a lobby floor is enabled with a zoned elevator.

Preferably the aforementioned lobby floors comprise one or more lobby floors, which is the topmost stopping floor of a zoned elevator belonging to the aforementioned zoned elevator plurality and/or the bottommost stopping floor of a zoned elevator belonging to the aforementioned zoned elevator plurality.

Preferably a zoned elevator comprises the aforementioned support structures at the top end and/or at the bottom end of the range of movement of its elevator car.

Preferably the elevator car of a zoned elevator is arranged to take vertical support force from the aforementioned support structures for vertically supporting and/or moving and/or stopping the elevator car.

Preferably the aforementioned support structures form a structure, supported by which the elevator car of a zoned elevator hangs.

Preferably the aforementioned support structures comprise a rope pulley, via which the roping connected to the elevator car of the zoned elevator in question travels. The support structures can thus function as support structures for the elevator car via the roping.

Preferably a zoned elevator comprises the aforementioned support structures at the top end and/or at the bottom end of the range of movement of its elevator car on the travel path of the elevator car. The support structures can thus function simply as support structures determining the top limit or bottom limit for the elevator car, mechanically preventing movement of the elevator car past them.

Preferably the aforementioned mounting structures comprise a guide rail of the elevator and/or a guide rail bracket and/or a wall structure of the elevator hoistway, on which guide rail and/or a guide rail bracket and/or a wall structure of the elevator hoistway the means (t) are arranged to directly rest. These structures can be simply arranged in a line in such a manner that the support point of the means (t) can be selected simply. More particularly, it is easy to select a support point when the means t are supported directly on a guide rail/on guide rails, such as on the guide rails of the elevator car and/or of a possible counterweight. Preferably the means (t) of zoned elevators that are one above another are arranged to directly rest on the same guide rails.

Preferably the aforementioned support structures comprise a hoisting machine, which is connected with the roping to the elevator car for moving the elevator car with the hoisting machine via the roping. A counterweight can be connected to the roping. In this way the support structures and the hoisting machine can be shifted in one operation. The structure can also be formed to be simple and compact and easily accessible.

Preferably the aforementioned support structures are between floor landing openings leading to consecutive floor landings, preferably above the top surface of the opening of the lower floor landing and below the sill of the opening of the upper floor landing. In this way an elevator car driven to the end together with the support structures occupies only a little vertical space. The arrangement can also be configured to be such that there are two zoned elevators one above the other such that the support structures determining the bottom limit of the range of movement of the upper zoned elevator and the support structures determining the top limit of the range of movement of the lower zoned elevator are support structures that are between floor landing openings leading to consecutive floor landings. In this way they can serve consecutive floors.

Preferably the hoisting machine of a zoned elevator is connected to the elevator car such that the elevator car is able to drive to the extreme position of its range of movement, in which it is at least partly alongside the hoisting machine, more particularly the traction sheave of it. In this way an elevator car driven to the end together with the support structures occupies only a little vertical space.

Preferably the motor moving the traction sheave of the hoisting machine of a zoned elevator is on the side of the vertical projection of the elevator car. In this way the elevator car can be driven to alongside the motor, and the elevator car together with its support structures occupies only a little vertical space.

Preferably the traction sheave of the hoisting machine of a zoned elevator is on the side of the vertical projection of the elevator car. In this way the elevator car can drive to alongside the traction sheave and the structure is compact in the vertical direction.

Preferably a zoned elevator comprises a counterweight, and the hoisting machine is disposed below or above the counterweight. Preferably the counterweight is shallower than the elevator car, in which case the total height of the counterweight and the hoisting machine is small and enables the driving of the elevator car to close to the end.

Preferably the hoisting machine of a zoned elevator is at least partly, preferably at least mainly, from its vertical dimension alongside the elevator car, more particularly alongside the interior of it, when the elevator car is at the point of the bottommost floor landing.

Preferably a zoned elevator comprises roping connected to the elevator car. Preferably the end(s) of the roping are connected to the elevator car to a clamp(s) on the side of the elevator car. In this way the elevator car can drive to alongside the traction sheave.

Preferably the elevator arrangement also comprises a control of the zoned elevator(s), which control determines with software the stopping floors of the zoned elevator(s), which control is reprogrammable such that the stopping floors can be programmed again.

Preferably the elevator arrangement comprises a machine room of a lobby elevator, which machine room is above the elevator hoistway of the lobby elevator, in which machine room is the hoisting machine, e.g. a motor and traction sheave, of the lobby elevator and also preferably the motor drive.

Preferably the hoisting machine of each aforementioned zoned elevator for moving the elevator car of the zoned elevator in question is in the elevator hoistway, in the same space as the elevator car.

In one embodiment the support structures at the top end of the range of movement comprise at least one of the following

- a walkway (service platform) above the elevator car,
- a diverting pulley system guiding the roping suspending the elevator car,
- means, such as a buffer, for stopping the elevator car or means for tripping a brake on the elevator car acting on a guide rail after the elevator car has risen over a certain distance from a support structure,
- a hoisting machine for moving the elevator car of the zoned elevator in question.

In one embodiment the support structures at the bottom end of the range of movement comprise at least one of the following

- a walkway, preferably a service platform, below the elevator car,
- a diverting pulley system guiding the roping connected to the elevator car,
- means, such as a buffer, for stopping the elevator car or means for tripping a brake on the elevator car acting on a guide rail after the elevator car has descended to below a certain distance from a support structure,
- a hoisting machine for moving the elevator car of the zoned elevator in question.

Preferably the elevator arrangement comprises one or more elevators above and/or below the zoned elevator in question and in the same elevator hoistway as the zoned elevator to be changed, in the manner specified, in respect of its range of movement, which one or more elevators is preferably a zoned elevator belonging to the aforementioned zoned elevator plurality and also to be changed in respect of its range of movement. In this way the elevator arrangement forms an elevator arrangement with which a large number of floors can be served, and which can be flexibly re-adjusted.

In one embodiment the stopping floors of a lobby elevator comprise one or more lobby floors, which is the stopping floor of at least two zoned elevators, which at least two zoned elevators have different ranges of movement and/or stopping floors to each other. In this way a lobby elevator can feed passengers via the same lobby floor to two zoned elevators.

Preferably the aforementioned at least two zoned elevators comprise two zoned elevators having the aforementioned lobby floor as the only common stopping floor. In this way it is possible to limit with the zoned elevators the passage of passengers to certain floors so that passage is only successful with certain elevators.

Preferably the ranges of movement of the aforementioned two zoned elevators extend from the lobby floor in opposite directions.

Preferably the aforementioned zoned elevator plurality comprises one or more zoned elevators, which stop at all the floors in their ranges of movement, and a lobby elevator that stops only at some of the floors in its range of movement.

In one embodiment the stopping floor (lobby floor) of one lobby elevator is the entrance floor of the building. In this case the solution can replace a solution of a shuttle-type feeder elevator that stops very infrequently. The arrangement in this case produces for passengers fast access to destination with a low number of stops.

Preferably from the elevator hoistway of a lobby elevator an access opening is arranged to lead to a floor, which is not a stopping floor of the lobby elevator, which access opening is provided with a door and/or is covered with a removable cover for taking it into use later, more particularly when later the floor in question is changed into a stopping floor of the lobby elevator. Thus commissioning is fast and the overall configuration of the lobby elevator and zoned elevator can be arranged to be optimal.

Preferably the aforementioned plurality of zoned elevators comprises one or more zoned elevator groups, which zoned elevator group comprises at least two elevators, which have different ranges of movement and at least one common stopping floor, which is also a stopping floor of a lobby elevator.

Preferably the aforementioned plurality of zoned elevators comprises zoned elevators one above another.

Preferably the aforementioned plurality of zoned elevators zoned elevator cars are arranged to provide service in one or more elevator hoistways.

Preferably a lobby elevator and a zoned elevator travel in parallel elevator hoistways.

In one embodiment the roping connected to the elevator car comprises a first part of suspending roping, which is connected to the elevator car and to the counterweight, and supports them while supported by support structures above the elevator car, and additionally, separate to the first part and aforementioned upper support structures, a second part of hoisting roping and a hoisting machine in connection with support structures below the elevator car, which hoisting machine is in power transmission connection via the second part with the elevator car and the counterweight.

In the method for re-adjusting the elevator arrangement, which elevator arrangement is one of the types described earlier, a zoned elevator that is in use, which is in use to serve passengers and/or to transport freight, is removed from the aforementioned use, and after this the range of movement of the elevator car of the zoned elevator in question is changed to reach to a different height in the elevator hoistway by changing the vertical location in relation to the building of the top limit and/or the bottom limit of the range of movement of the elevator car of the zoned elevator in question, and after this the zoned elevator is taken back into the aforementioned use. In this way the elevator arrangement can be adapted after the actual commissioning to be optimal with regard to changing needs. With the procedures of the method the advantages specified in connection with the description of the structural features above can be achieved.

Preferably the vertical location of the top limit and/or the bottom limit of the range of movement of the elevator car of a zoned elevator is changed by displacing the means determining the location of the top limit/bottom limit of the range of movement in the vertical direction, which means are detachably supported in their position in the elevator hoistway.

Preferably in the method the aforementioned means, which are preferably the support structures of the zoned elevator in question, are detached from the mounting structures functioning as a support mounting, above and/or below which mounting structures are corresponding mounting structures, and the means are displaced in the vertical direction and the means are fixed again at a different height in the elevator hoistway to the aforementioned corresponding mounting structures above or below.

Preferably the elevator arrangement comprises a plurality of zoned elevators of the type mentioned, and in the method the range of movement of the elevator car of a number of zoned elevators is changed to reach to a different height in the elevator hoistway in the manner specified above.

Preferably the distance to be displaced is a floor-to-floor distance of the building or a multiple of a floor-to-floor distance.

Preferably the aforementioned zoned elevator has a corresponding zoned elevator at least above it or below it, the range of movement of which is changed in the manner specified above, in which case the lower of these has a range of movement to be changed at least from the location of the top limit, and the upper of these has a range of movement to be changed at least from the location of the bottom limit, and the location of the top limit of the range of movement of the lower zoned elevator and the location of the bottom limit of the range of movement of the upper zoned elevator are changed in the same direction. In this way the service of a floor can be shifted from one zoned elevator to another.

Preferably the zoned elevator in question comprises the aforementioned means at the top end and/or at the bottom end of its range of movement.

Preferably the elevator hoistway of a lobby elevator is essentially the height of the whole building.

Preferably the aforementioned zoned elevator plurality comprises zoned elevators one above another, which travel in the same elevator hoistway guided by the same guide rails, and the elevator hoistway in question is essentially the height of the whole building.

Preferably the aforementioned guide rails and/or guide rail brackets of a zoned elevator form the aforementioned mounting structures.

Preferably the elevator arrangement also comprises a lobby elevator, the range of movement of the elevator car of which differs from the ranges of movement of the aforementioned zoned elevators, and the stopping floors of which lobby elevator comprise a plurality of lobby floors, each of which is a stopping floor of one or more zoned elevators belonging to the aforementioned zoned elevator plurality, and that from the elevator hoistway of the lobby elevator an access opening is arranged to lead to one or more floors, which is not a stopping floor of the lobby elevator, which access opening is provided with a door and/or is covered with a removable cover (for taking it into use later, more particularly when later the floor in question is changed into a stopping floor of the lobby elevator), and in the method the aforementioned floor, which is not a stopping floor of the lobby elevator, is changed into a stopping floor of the lobby elevator and of a zoned elevator, in which case preferably the access opening between the elevator hoistway and the aforementioned floor landing that has been out of use is taken into use, in which case preferably

- the aforementioned possible cover is removed, or
- a possible locking of a door is removed, or
- the aforementioned possible cover is removed and a door is installed.

The elevator arrangement is most preferably an elevator arrangement applicable to the transporting of people and/or of freight, the elevators of which are installed in a building, to travel in a vertical, or at least essentially vertical, direction, preferably on the basis of landing calls and/or car calls. Each elevator car preferably has an interior space, which is most preferably suited to receive a passenger or many passengers and, in addition or alternatively, freight. The zoned elevators and the lobby elevators preferably each comprise at least two, preferably more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein.

DETAILED DESCRIPTION OF THE INVENTION

Figure 1A:
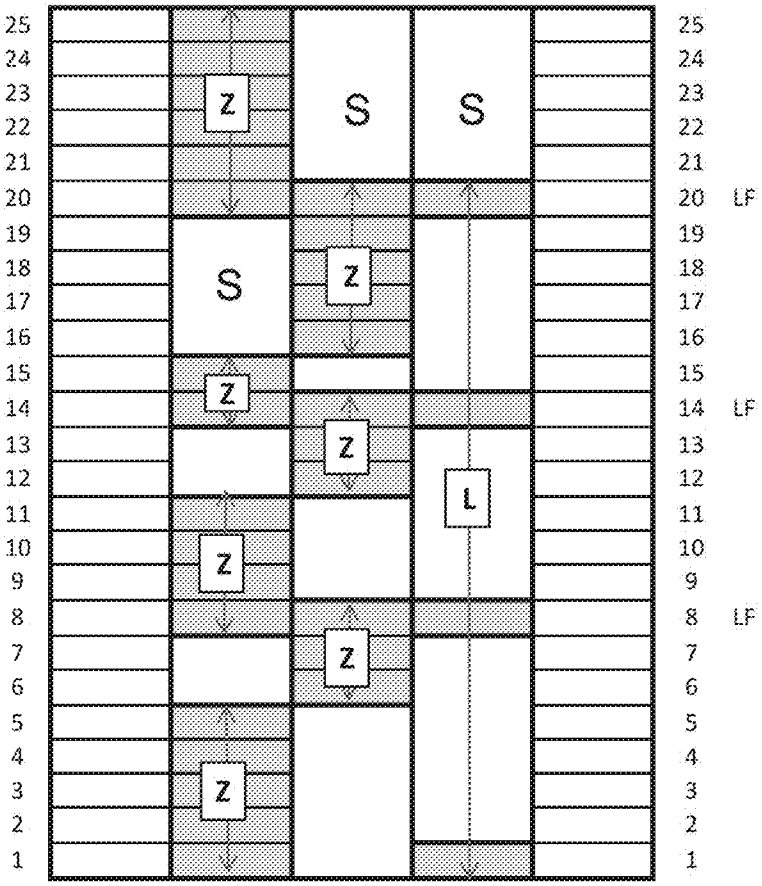
FIG. 1*a* presents one preferred embodiment of an elevator arrangement according to the invention.

FIG. 1*a* presents an elevator arrangement according to the invention, which comprises a plurality of elevators Z, L in a building. The building can be e.g. a tower block. The elevator plurality comprises a plurality of zoned elevators Z in passenger service use, which zoned elevators Z each have a top limit and/or a bottom limit of the range of movement of the elevator car, the vertical location, in relation to the building, of which can be changed in the vertical direction (to be disposed higher or lower), and to above/below the top limit/bottom limit of which range of movement travel of the elevator car of the zoned elevator (Z,Z') in question is prevented. The zoned elevators Z have different ranges of movement of the elevator car in the building to each other. In the figures, the range of movement of the elevator car of each elevator is marked with an arrow and a stopping floor is shaded. Travel to above the top limit and to below the bottom limit travel is preferably prevented in a manner presented elsewhere in this application, e.g. mechanically. For enabling convertibility the zoned elevators to be changed with respect to their ranges of movement comprise re-adjustable means determining the top limit and/or bottom limit for the provision of service by the elevator car of a zoned elevator. Owing to the convertibility, the layout of the final zoned elevators Z of a finished building can be changed after commissioning of the elevator arrangement after the zoned elevators have been in operation, for instance, for a number of years. The elevator arrangement also comprises a lobby elevator L in passenger service use, the range of movement of the elevator car of which differs from the service ranges of the aforementioned zoned elevators Z, and the stopping floors of which lobby elevator L comprise a plurality of lobby floors LF, each of which is a stopping floor of one or more zoned elevators Z belonging to the aforementioned zoned elevator plurality. The range of movement and the stopping floors of the lobby elevator L differ from the ranges of movement and the stopping floors of the aforementioned zoned elevators Z at least such that each zoned elevator Z has one or more stopping floors, which is not a stopping floor of the lobby elevator L. In the embodiment presented, the range of movement of a lobby elevator is also different in respect of the bottom and top limits, because the length of its range of movement is greater than the ranges of movement of the aforementioned zoned elevators Z. The aforementioned lobby floors LF comprise lobby floors LF (floors 8, 14 and 20), which are the topmost stopping floor of a zoned elevator Z belonging to the aforementioned zoned elevator plurality and lobby floors LF (floors 1, 8, 14 and 20), which are the bottommost stopping floor of a zoned elevator Z belonging to the aforementioned zoned elevator plurality. The stopping floors of the lobby elevator can be determined e.g. by the aid of the settings of the control or by suitably limiting the selection options of the call-giving pushbuttons. The aforementioned zoned elevators Z, or at least some of them, are preferably such that the elevator car of it stops at all the floors of its range of movement. The lobby elevator preferably stops at only some of the floors of its range of movement, more particularly at the aforementioned lobby floors LF.

The elevator arrangement presented comprises one or more elevators that are in the same elevator hoistway as a zoned elevator Z to be changed in respect of its range of movement and that are above and/or below the zoned elevator in question that is to be changed, which one or more elevators are also zoned elevators Z belonging to the aforementioned zoned elevator plurality and also to be changed in respect of their range of movement. In the embodiment presented all the zoned elevators Z presented can have their top limit and/or bottom limit of the range of movement of their elevator cars changed, but it is obvious that advantages would be obtained even if only some of the zoned elevators Z presented were to be changeable in this manner. In the solution presented the zoned elevators Z travel in two elevator hoistways that are beside each other, and the stopping floors of the lobby elevator L comprise, inter alia, lobby floors LF (floor 8, 14, 20), which is the stopping floor of two zoned elevators Z, which at least two zoned elevators have different stopping floors to each other, and in the embodiment presented also different ranges of movement. The common (preferably the only common) stopping floor of these two zoned elevators is the aforementioned lobby floor LF, and the ranges of movement of the aforementioned two zoned elevators extend from the lobby floor LF in opposite directions. The aforementioned plurality of zoned elevators Z comprises a number of this type of zoned elevator groups, of which each comprises at least two zoned elevators Z, which have different ranges of movement and at least one common stopping floor, which is also a stopping floor of the lobby elevator. The advantage of a common stopping floor is that in this way the number of stopping floors of the lobby elevator L can be kept low. The zoned elevators of the same zoned elevator group can, if necessary, be situated so that they have instead of one (as presented in FIG. 1*a*) common stopping floor a number of common stopping floors. Likewise, if necessary, they can be situated so that the common stopping floor of a zoned elevator and a lobby elevator is not necessarily the topmost or bottommost stopping floors of one, or of either, of these. For example, in FIG. 1*a* the zoned elevator on the left could extend from its bottom end to reach to floor 7 and the zoned elevator on the right-hand side from its top end to floor 9. As presented in the figures, the elevator arrangement can comprise a number (e.g. 2, but also more, such as 3 or 4) elevator hoistways in each of which is a plurality of the aforementioned zoned elevators Z' one above another in passenger service use. On the other hand, the invention could also be applied with a smaller number of zoned elevators in each elevator hoistway.

Figure 1B:
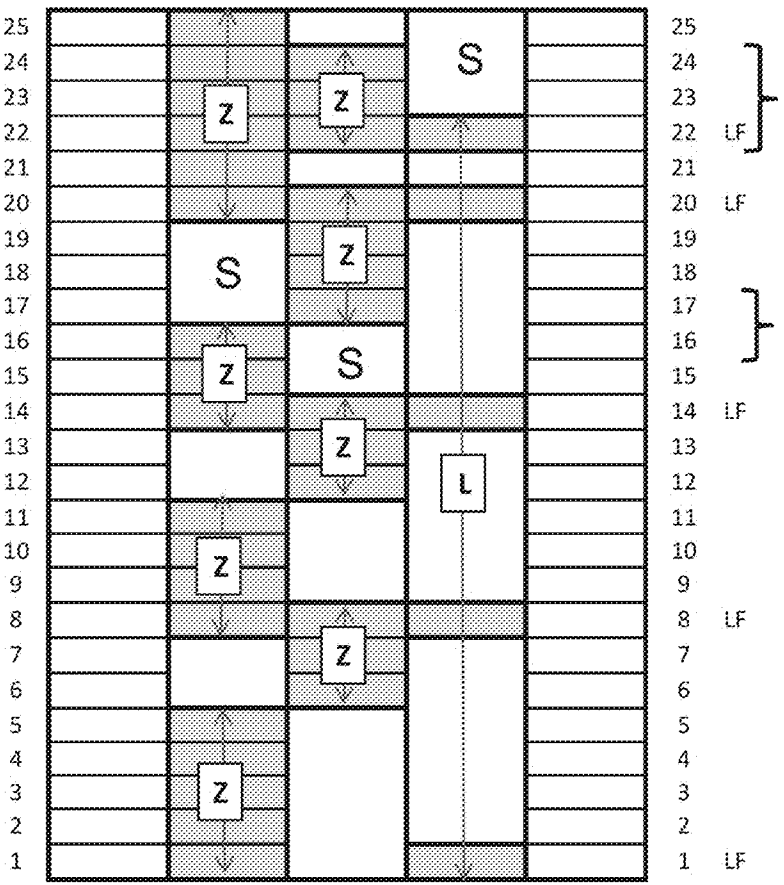
FIG. 1*b* presents the elevator arrangement according to FIG. 1*a* re-adjusted in a manner according to one method according to the invention.

The layout of the zoned elevators Z' presented in the figure enables a re-arrangement of the flows of people simply. With the solution the route along which the floors can be reached can also be changed. Thus, for example, it is possible to even out the load of consecutive zoned elevators Z when heavy loading of some zoned elevator is noticed. Likewise an increase or decrease in the service speed of some floors becomes possible. More particularly when traffic movements on the floors changes, the transport capacity to some floors can be increased quickly. Likewise it might be advantageous to reduce the transport capacity to some other floors. The arrangement thus enables better prioritization of the floors than before. Changes can be caused by, inter alia, the changing needs of companies operating in the building or of residential floors. For example a need might arise for an elevator that has been in the use of a company to serve some additional floor. For example, when a company expands upwards or downwards in the building, there can be a need to extend a zoned elevator Z to stop, in addition to the earlier floors, also at the point of the new office floors of the company. The layout also simply enables companies operating in the building or residential floors to differentiate themselves from each other so that there is access to certain floors only with a certain zoned elevator. In this way e.g. the access control and management of a company is efficient, because a zoned elevator can be designated to a company operating on certain floors or to residential floors, which zoned elevator gives access to these floors and which zoned elevator only stops at these floors and at which floors the only elevators that stop are those that can only be used via access from a lobby floor LF. The layout presented is advantageous when the zoned elevators can be changed in respect of their range of movement, although the layout would leave ample free space in the hoistway, because the elevator arrangement is flexible for later needs for change in which it is desired to fill the hoistway more efficiently or, for one reason or another, to change the ranges of movement. FIG. 1*b* presents an elevator arrangement according to the invention, into which the elevator arrangement according to FIG. 1*a* can be converted. It can, of course, be necessary to form the elevator arrangement in question as it is already in connection with initial installation, or the change could occur from the solution of FIG. 1*b* to the solution of FIG. 1*a*. The changes presented between the figures illustrate the convertibility of the elevator system according to the invention and the re-adjustment procedures of the method according to the invention. Square brackets indicate floors on which modifications have been made.

The top limit of the range of movement of the elevator car of the zoned elevator of FIG. 1*a* able to ascend up to floor 15 has been moved higher to extend to floor 16. The bottom limit of the range of movement of the elevator car of the zoned elevator able to descend down to floor 16 in the adjacent hoistway has been moved higher to extend to floor 17 instead of floor 16. A new zoned elevator Z has been installed at the point of floors 22-24, and the lobby elevator L has been arranged to stop also at the stopping floor 22 of the zoned elevator in question. The elevator cars of the zoned elevator plurality of this embodiment are arranged to provide service in two elevator hoistways S such that zoned elevators one above another move in each elevator hoistway. In addition to the types of hoistways and zoned elevators presented there can also be more than those presented. The lobby elevator and a zoned elevator travel in parallel elevator hoistways, in which case from the stopping floor of the lobby elevator transfer can be laterally to the elevator car of a zoned elevator.

Figure 2B:
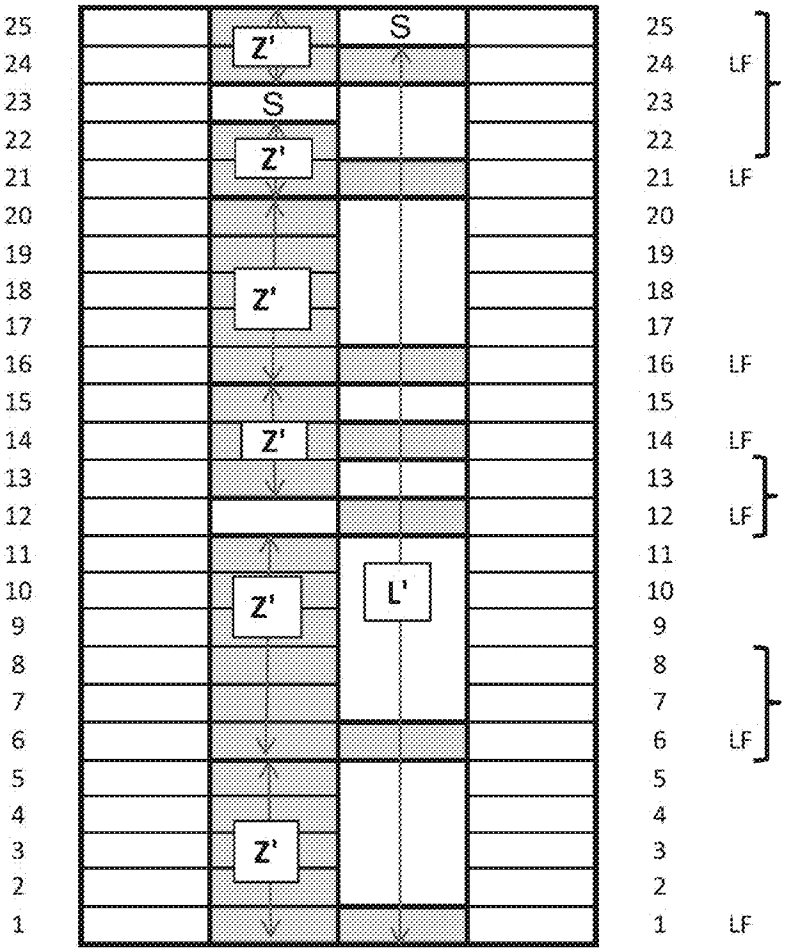
FIG. 2*b* presents the elevator arrangement according to FIG. 2*a* re-adjusted in a manner according to one method according to the invention.
Figure 2A:
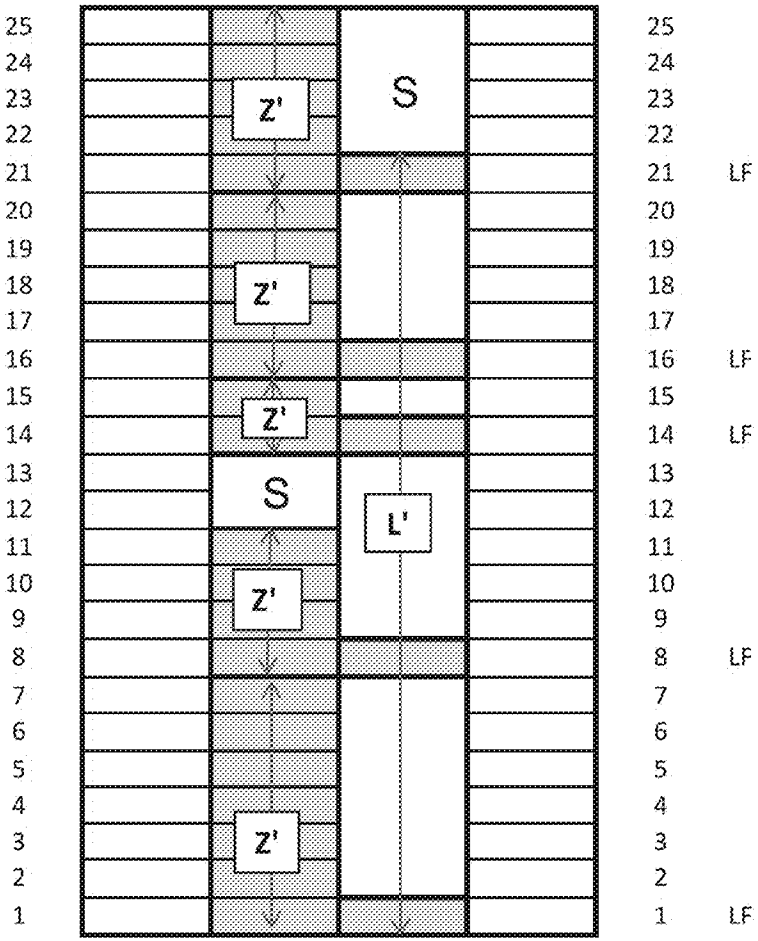
FIG. 2*a* presents one second preferred embodiment of an elevator arrangement according to the invention.

FIG. 2*a* presents an elevator arrangement according to the invention, which comprises a plurality of elevators Z', L' in a building. With the arrangement the hoistway space of an elevator hoistway S comprising zoned elevators can be efficiently utilized. The arrangement operates in most respects as described in FIGS. 1*a*-1*b*, but this solution can be simply utilized even with only one elevator hoistway comprising zoned elevators Z', but if necessary also with a number of these types of elevator hoistways. In the arrangement presented the elevator plurality comprises a plurality of zoned elevators Z', one above another, that are in passenger service use in the same elevator hoistway S, which zoned elevators Z' each have a top limit and/or a bottom limit of the range of movement of the elevator car, the location, in relation to the building, of which can be changed in the vertical direction, and to above/below the top limit/bottom limit of which range of movement travel of the elevator car of the zoned elevator Z' in question has been prevented. The zoned elevators Z' have different ranges of movement of the elevator car in the building to each other. Preferably the ranges of movement of zoned elevators Z,Z' one above another do not intersect each other, in which case the solution is safe because the elevator cars do not have access to the ranges of movement of each other. In the figures, the range of movement of each elevator car of an elevator Z', L' is marked with an arrow and the stopping floor is shaded. Travel to above the top limit and to below the bottom limit travel is preferably prevented in a manner presented elsewhere in this application, e.g. mechanically. For enabling convertibility the zoned elevators to be changed with respect to their ranges of movement comprise re-adjustable means determining the top limit and/or bottom limit for the provision of service by the elevator car of a zoned elevator. The re-adjustable means can comprise e.g. means adjustable by displacing them, such as support structures that can be shifted in the vertical direction, of which some preferred embodiments are given elsewhere in this application. Owing to the convertibility, the layout of the final zoned elevators Z' of a finished building can be changed after commissioning of the elevator arrangement after the zoned elevators have been in operation, for instance, for a number of years. The elevator arrangement also comprises a lobby elevator L' in passenger service use, the range of movement of the elevator car of which differs from the service ranges of the aforementioned zoned elevators Z', and the stopping floors of which lobby elevator L comprise a plurality of lobby floors LF, each of which is a stopping floor of a zoned elevator Z' belonging to the aforementioned zoned elevator plurality. The range of movement and the stopping floors of the lobby elevator L' differ from the ranges of movement and the stopping floors of the aforementioned zoned elevators Z' at least such that each zoned elevator Z' has one or more stopping floors, which is not a stopping floor of the lobby elevator L'. Preferably, as in the embodiment presented, the range of movement of the lobby elevator L' is also different compared to zoned elevators in respect of the bottom and top limits, because the length of its range of movement is greater the ranges of movement of the aforementioned zoned elevators Z'. The stopping floors of the lobby elevator L' can be determined e.g. by the aid of the settings of the control or by suitably limiting the selection options of the call-giving pushbuttons. The stopping floors of the lobby elevator L' can preferably be changed. The aforementioned zoned elevators Z', or at least some of them, are preferably such that the elevator car of it stops at all the floors of its range of movement. The lobby elevator L' preferably stops at only some of the floors of its range of movement, more particularly at the aforementioned lobby floors LF.

The elevator arrangement presented comprises one or more elevators that are in the same elevator hoistway as each aforementioned zoned elevator Z' to be changed in respect of its range of movement and that are above and/or below the zoned elevator in question that is to be changed, which one or more elevators are also zoned elevators belonging to the aforementioned zoned elevator plurality and also to be changed in respect of their range of movement. For achieving efficient filling of the elevator hoistway, the elevator arrangement comprises in the same hoistway, inter alia, two zoned elevators that are consecutive in the vertical direction, of which the bottommost stopping floor of the upper one is only one floor above the topmost stopping floor (=next floor) of the lower of the aforementioned two zoned elevators. The lobby elevator stops at least one stopping floor of both these zoned elevators. There are preferably a number of these types of zoned elevators consecutively, in which case space usage of the building is efficient.

The layout of the zoned elevators Z' presented in the figure enables a re-arrangement of the flows of people simply. More particularly, with the solution the route along which the floors can be reached can be changed. Thus, for example, it is possible to even out the load of consecutive zoned elevators Z' when heavy loading of some zoned elevator is noticed. Likewise an increase or decrease in the service speed of some floors becomes possible. The arrangement thus enables better prioritization of the floors than before. The layout also simply enables the differentiation of companies operating in the building and residential floors from each other such that there is access to certain floors only with a certain zoned elevator, while at the same time access to all floors is however possible with a zoned elevator moving in the same elevator hoistway. Thus, for example, the access control of a company is effective, because a zoned elevator can be designated to a company operating on certain floors or to residential floors, which zoned elevator gives access to these floors and which zoned elevator only stops at these floors and at which floors the only elevators that stop are those that can only be used via access from the lobby floor LF of the zoned elevator in question. The layout presented is advantageous when the zoned elevators must be changed in respect of their range of movement, the elevator arrangement is flexible for later needs for changes because of which it is desired, for one reason or another, to change the ranges of movement. For example, when a company expands upwards or downwards in the building, there can be a need to extend a zoned elevator Z to stop, in addition to the earlier floors, also at the point of the new office floors of the company. In the embodiment presented all the zoned elevators presented can have the top limit and/or bottom limit of the range of movement of their elevator cars changed, but it is obvious that advantages would be obtained even if only some of the zoned elevators presented were to be changeable in this manner.

FIG. 2*b* presents an elevator arrangement according to the invention, into which the elevator arrangement according to FIG. 2*a* can be converted. The elevator arrangement in question can, of course, be formed as it is already in connection with initial installation, or the change could occur from the solution of FIG. 2*b* to the solution of FIG. 1*a*. The changes presented between the figures illustrate the convertibility of the elevator system according to the invention and the re-adjustment procedures of the method according to the invention. Square brackets indicate floors on which modifications have been made. The top limit of the range of movement of the elevator car of the zoned elevator of FIG. 2*a* able to ascend up to floor 25 has been moved lower to extend to floor 22. A zoned elevator has been added above it to travel between floors 24-25. The lobby elevator L' has been modified to stop also at its stopping floor 24, which is thus arranged to form a lobby floor LB for the new zoned elevators Z' of floors 24-25. The bottom limit of the range of movement of the elevator car of the zoned elevator able to descend down to floor 14 has been moved lower to extend to floor 13 instead of floor 14. The lobby elevator L' has also been modified to stop also at floor 12, which is thus arranged to form a new lobby floor LB, from where in fact there is no elevator connection up or down. The bottom limit of the range of movement of the elevator car of the zoned elevator able to ascend up to floor 7 has been moved lower to extend to floor 5. Above it, the bottom limit of the range of movement of the elevator car of the zoned elevator able to descend down to floor 8 has been moved lower to extend to floor 6 instead of floor 8. A stopping floor of the lobby elevator has been added to floor 6 to form a lobby floor LF for the zoned elevator Z' in question. The lobby elevator and a zoned elevator travel Z' travel in parallel elevator hoistways, in which case transfer from the stopping floor of the lobby elevator can be laterally to the elevator car of a zoned elevator. The elevator hoistways S of the type presented in FIGS. 2*a*-2*b*, in which the elevator cars of zoned elevators Z' travel, could also be placed one beside another, either such that the ranges of movement of the elevator cars of the zoned elevators Z' of elevator hoistways S that are beside each other are corresponding, or such that they at least partly differ from each other. In this case also the overall hoistway space could be efficiently utilized.

It is obvious that the changes presented in FIGS. 1*a*-1*b* and 2*a*-2*b* only visualize the convertibility of the elevator system, and each of the changes can be made on its own or all the changes can be made or only a plurality of them. The lobby elevator L,L' can be some high-rise elevator according to prior art, and it does not need to be changed in respect of the limits of its range of movement. Preferably it is an elevator, the hoisting machine of which is not supported in its position in the elevator hoistway in a displaceable manner, in which case the hoisting machine is preferably in a machine room above the elevator hoistway. Preferably its hoisting machine moves the hoisting roping R, supported by which the elevator car ($C_L$, presented in FIG. 3) of the lobby elevator is suspended. In this way the lobby elevator L,L' can be simply formed to possess a large capacity. For example, the speed of movement and nominal load of its elevator car can be formed to be large because, inter alia, the machine size can be freely selected to be large. The designed travel height of the lobby elevator can be e.g. the length of the whole hoistway presented in FIGS. 1*a* and 1*b*/2*a* and 2*b*, in which case structural modifications to the lifting function or to the mechanical structures limiting the range of movement are not needed. On the other hand, it can be necessary to add or to close access to a new stopping floor, for which various embodiments are presented elsewhere in this application. The elevator car $C_Z$ of a lobby elevator can travel guided by the guide rails $GR_L$ of the lobby elevator by the aid of guide shoes g in connection with the elevator car $C_Z$, as is presented in FIG. 3.

Figure 3:
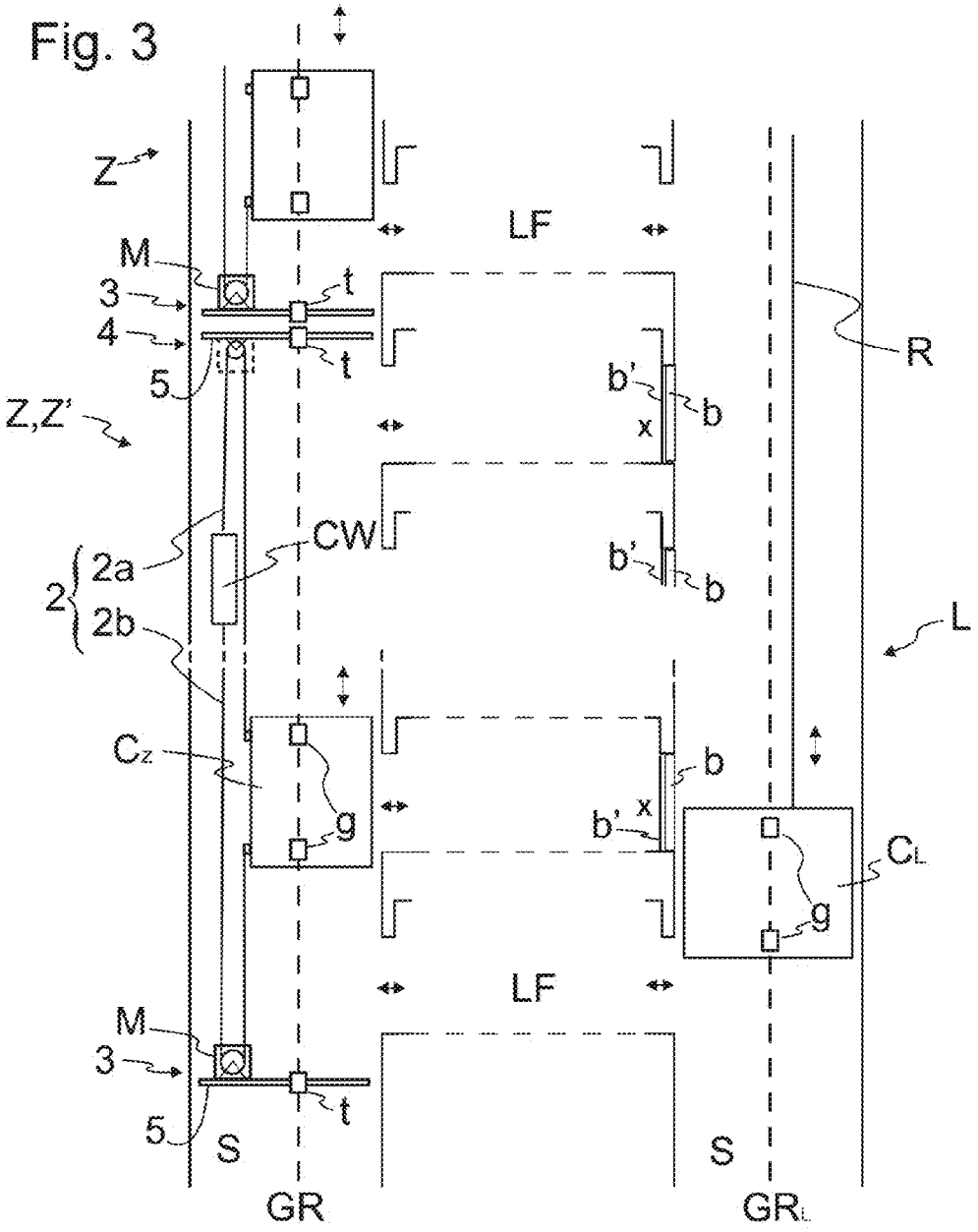
FIG. 3 presents an elevator configuration, according to which a/some zoned elevator(s) can be formed in the elevator arrangement.
Figure 7:
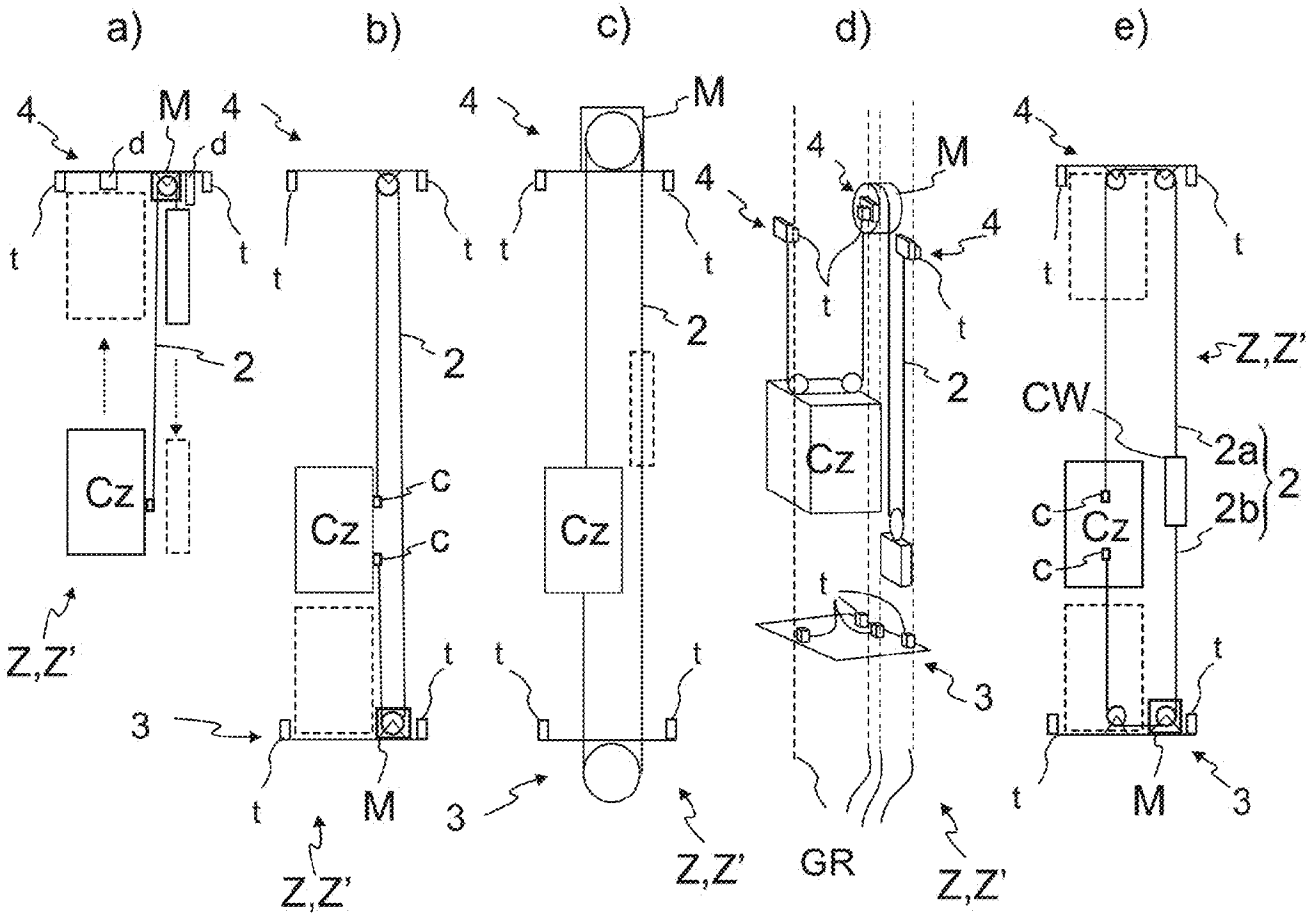
FIG. 7 presents a plurality of preferred elevator configurations 7*a*-7*e*, according to which a/some zoned elevator(s) can be formed.

FIGS. 3 and 7 present side views of various alternative zoned elevator configurations, according to which the location, in relation to the building, of the top limit and/or bottom limit of the range of movement of the elevator car of a zoned elevator can be arranged to be changeable in the vertical direction. Each of these can be used in the elevator arrangements of FIGS. 1*a*-2*b*. The elevator can be one with a counterweight, such as is presented in FIG. 3, 7*a* or 7*c*, 7*d*, 7*e*, or one without a counterweight, such as is presented in FIGS. 7*b* and 7*c* (in the counterweight option, the counterweight is described with a dashed line). In the solutions presented, a zoned elevator Z,Z' comprises roping 2, which is connected to the elevator car Cz.

In the embodiments presented, the zoned elevators (Z,Z') each have a top limit and a bottom limit of the range of movement of the elevator car, to above the top limit and to below the bottom limit of which range of movement travel of the elevator car of the zoned elevator (Z,Z') in question is mechanically prevented by the action of the support structures (3,4). Each zoned elevator (Z,Z') comprises vertically movable support structures (3,4) detachably supported in their position in the elevator hoistway, the vertical location of which in the elevator hoistway determines the location of the top limit/bottom limit of the range of movement of the elevator car of the zoned elevator in question. The aforementioned support structures (3,4) are detachably supported in their position in the elevator hoistway on mounting structures (GR) functioning as a support base, above and/or below which mounting structures are corresponding mounting structures (GR) such that the support structures (3,4)

detachably supported in their position can be detached from their mounting structures (GR) and displaced in the vertical direction and fixed again at a different height in the elevator hoistway (S) to the aforementioned mounting structures (GR) above or below. In this way shifting the support structures is quick, and large structural modifications do not need to be made to the area of the new location. More particularly the aforementioned support structures (3,4) comprise means (t) with which the aforementioned support structures (3,4) are detachably supported in their position on mounting structures (GR). The mounting structures comprise structures of the elevator hoistway itself or structures (such as guide rails) in the elevator hoistway, and above and/or below the aforementioned mounting structures are corresponding mounting structures such that the support structures (3,4) detachably supported in their position can be detached by opening the means (t) and displaced and fixed again at a different height in the elevator hoistway to the aforementioned mounting structures above or below. Above and below the mounting structures (GR, guide rails in the figures), on which the support structures are supported with the means t, are corresponding supporting mounting structures such that the support structures (3,4) detachably supported in their position can be detached by opening the means t and displaced and fixed again at a different height in the elevator hoistway to the aforementioned mounting structures above or below. The aforementioned mounting structures comprise a guide rail (GR) of an elevator and/or a guide rail bracket, which in the figures is illustrated with a dashed line describing the line formed by the guide rails. The guide rails of an elevator are generally rigid structures, such as metal pieces, guided by which the elevator car travels by the aid of guide shoes g in connection with the elevator car, as presented in FIG. 3. A possible counterweight travels guided by its own guide rails, which guide rails and/or their guide rail brackets can be used as a support mounting. Corresponding features are preferably present in the embodiments of FIG. 7. The guide rails of the elevator car and of a possible counterweight are generally fixed by the aid of guide rail bracket at intervals. The guide rails and guide rail brackets form a line, in the longitudinal (vertical) direction of the hoistway, comprising these structures facing each other in the lateral direction, which line continues essentially the whole distance of the range of movement of the elevator car/counterweight and preferably also the whole length of the elevator hoistway. The guide rails and/or a guide rail brackets form a good mounting structure, on which the means t can be supported. In this way it is simple to achieve the same type of support at the desired height in the hoistway without adding new mounting structures. The means t are preferably supported directly on this/these guide rail/guide rails and/or guide rail bracket/guide rail brackets. In this way, therefore, essential structural changes to the conventional elevator structure are not needed for the purpose of a support mounting. Alternatively the aforementioned mounting structures can comprise a wall structure of the elevator hoistway, on which wall structure the means t are arranged to directly rest. Also the wall structures of the elevator hoistway continue in a line.

A zoned elevator (Z,Z') can comprise the aforementioned support structures at the top end and/or at the bottom end of the range of movement of its elevator car. In FIGS. 3 and 7*b*-7*e*, the elevator comprises a support structure 4 at the top end and a support structure 3 at the bottom end of the range of movement of its elevator car. The support structure at the bottom end can simply limit movement directed downwards and the one at the top end movement directed upwards. The support structure 3 or 4 can, however, be configured to limit movement of either desired direction whatsoever in certain cases. For example, in the manner presented by FIG. 7*a*, wherein downward movement of the elevator car is limited (thus forming a bottom limit to the range of movement) by movement of the element, here the counterweight, fixed to the roping suspending the elevator car (the car in its extreme position is described with a dashed line). In FIG. 7*a*, in fact, there are only the aforementioned support structures 4 in the top end. In a corresponding manner (by the aid of an element, such as a counterweight, fixed to the roping) the range of movement of the elevator car could be limited with only the support structure 3 in the bottom end. A buffer d on the travel path of the elevator car/counterweight, or other types of means for affecting the movement of the elevator car or counterweight, can also be in connection with the support structure 3,4, such as e.g. a detent means, which is arranged to activate a brake of the elevator car via a countermeans operatively connected to the brake on the elevator car, if the countermeans of the elevator car moves to the point of the detent means. These types of means are known by the name pre-triggered braking device. The support structures (3,4), the vertical location of which in the elevator hoistway can determine the location of the top limit/bottom limit of the range of movement of the elevator car of the zoned elevator in question mechanically, also on the other hand limiting by being at least partly in front of the elevator car. The buffer d is presented only in FIG. 7*b*, but one/some (or other types of means for acting on the movement of the elevator car or counterweight) could also be in connection with the support structures (3,4) of the solutions presented by the other figures.

In the solutions of FIGS. 3 and 7, the aforementioned support structures 3,4 are structures from which the elevator car is arranged to take vertical support force for vertically supporting and/or moving the elevator car. In this way the location of the support structures can determine the location of the aforementioned top limit/bottom limit mechanically, for this reason also limiting in that the support structure is not able to transmit the support force needed for moving the elevator car to the elevator car via the roping past a certain location of the elevator car, which location depends, e.g. in the embodiments of FIGS. 3 and 7, on the locations of the rope pulleys.

The aforementioned support structures 3,4 in the solutions of FIGS. 3 and 7 comprise support structures 4 at the top end of the path of movement of the elevator car of a zoned elevator Z,Z', which form structures supported by which the elevator car of the zoned elevator Z,Z' hangs via the rope(s) comprised in the roping 2. The roping 2 travels over the top of a rope pulley in connection with the support structures 4 and supported by the support structures 4, taking the support force needed for supporting the elevator car from the rope pulley in question, which in turn takes vertical support by the aid of the means t comprised in the support structures from the mounting structures GR, in the solutions presented from the guide rails. The rope pulley in question can be a so-called traction sheave, in which case the rope pulley in question is a part of the hoisting machine M of the elevator in question. The hoisting machine M preferably comprises a motor, such as an electric motor, for rotating the traction sheave. This type of implementation is presented in FIGS. 7*a* and 7*d* as well as in FIG. 3 with a dashed line, because in fact the figure in question shows that the machine M is connected to the support structures that are at the bottom end of the path of movement of the elevator car and that are comprised in the support structures 3. The lifting force could thus be alternatively produced with the hoisting machine connected to other than the rope pulley of the support structures 3.

Figure 4A:
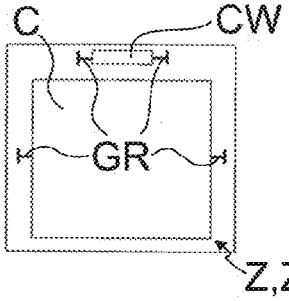
FIG. 4*a* presents a cross-section of an elevator hoistway in a solution wherein a zoned elevator comprises an elevator car and a counterweight.
Figure 4B:
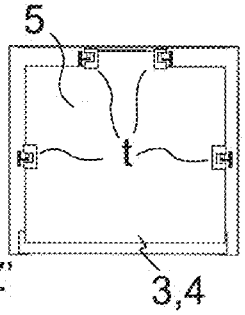
FIG. 4*b* presents a support structure above or below the elevator car of the zoned elevator according to FIG. 4*a*.
Figure 5:
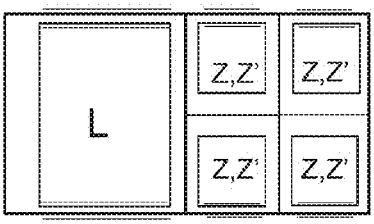
FIG. 5 presents a preferred layout for zoned elevators and for a lobby elevator.
Figure 6:
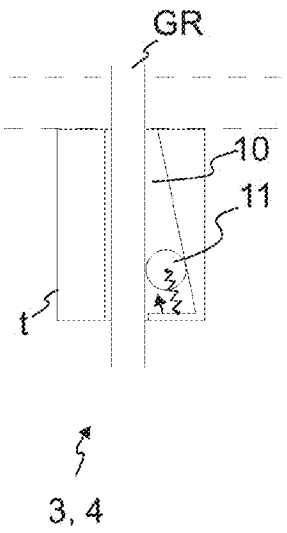
FIG. 6 presents a preferred embodiment for the means with which the support structures can be detachably fixed onto the mounting structures.

The support structure 3 and/or 4 preferably comprises a walkway below the elevator car, which can thus form a servicing platform. This is particularly advantageous when the support structure in question comprises a hoisting machine M, because in this case servicing of the hoisting machine M can be performed while standing on the support structure. FIG. 4*b* presents what the projection of the walkway could be like in this case. Preferably in this case it would comprise a flat top surface, on which a person can stand. Preferably it would also cover at least 80% of the cross-sectional area of the elevator hoistway in question, thus preventing a person or objects from falling off the platform. The figure also illustrates one embodiment for supporting the support structure 3,4 on the support mounting structures, i.e. in this case the guide rails GR. FIG. 6 presents a preferred structure for means t, with which the support structures 3 and/or can be detachably supported in their position directly on the mounting structures (GR).

The means t are openable/closable means, which can be shifted between an open position and a closed position. They form compression means, which in the closed position compress the mounting structures GR from two sides, and in the open position do not compress the mounting structures from two sides. In the embodiment according to FIG. 6 the means t comprise wedging means 10,11 for achieving a compression effect, with which wedging means the body of the means t can be supported with the wedge principle directly on a guide rail such that movement of the means t downwards increases the wedging and thus the compression exerted on the guide rails. The structure can be corresponding to that in prior-art safety gears of elevators. Preferably the means t comprise a wedge housing 10 tapering upwards, via which the guide rail GR travels and a wedge piece, such as e.g. a roller, which while resting on the guide rail GR is able to wedge between the surface of the upward tapering wedge housing and the guide rail GR, if the means t are taken downwards. The wedge piece can be spring-loaded towards the wedging position, i.e. towards the narrower end of the wedge housing (in the figure obliquely upwards). The means t can be detached from the guide rail GR by lifting them, e.g. by lifting the support structures 3 or 4, which support structures 3 or 4 the means t in question comprise, in which case the means t rise. The means t can also comprise means (not presented) for locking the wedge piece 11 in a desired position, e.g. in a non-wedging position, in which case moving the support structures 3,4 is simple both upwards and downwards. Each of the support structures 3 or 4 do not necessarily need to be a structure joined together in respect of all the parts, but it is advantageous from the viewpoint of the speed of displacing it. FIG. 7*d* presents an alternative, in which the support structure 3 is a structure joined together in respect of all the parts, and the support structure 4 is based on a number of parts supported in their position separate from each other. Also in FIG. 4 the support structures 4 (in the figure, rectangular prisms) are supported by the aid of the means t directly on the guide rails GR (here the guide rails of the elevator car Cz and the guide rails of the counterweight CW).

FIG. 3 additionally presents more precisely the advantageous features that are present in other embodiments also. As presented in the figure the lobby elevator L and the zoned elevators Z,Z' travel in different hoistways. The figure presents one hoistway of a zoned elevator, and describes an embodiment of one such with which the elevator arrangement of FIG. 2*a*-2*b* could be implemented, e.g. when the lobby floors LF describe the floors 16 and 21 of FIG. 2*a*. Correspondingly, with the structure the elevator arrangement of FIGS. 1*a*-1*b* can be implemented, of which FIG. 3 describes only the second zoned elevator hoistway S.

The stopping floors of the lobby elevator L, at which thus the elevator car CL of the lobby elevator is able to stop and the passengers are able to transfer to the floor landing of the lobby floor LF, is marked with arrows at the point of the aperture leading from the hoistway S to the landing. The stopping floors of the zoned elevator are marked correspondingly. The floors from which there is no passage from an elevator car of the lobby elevator L to a floor landing are marked with the reference number X. On these floors from the elevator hoistway S of the lobby elevator L an access opening is arranged to lead to a floor, which is not a stopping floor of the lobby elevator L, which access opening is provided with a locked door b and/or covered with a removable cover b' for taking it into use later, more particularly when later the floor in question is changed into a stopping floor of the lobby elevator. Thus if it is desired to change the location of the common stopping floor of a zoned elevator Z,Z' and the lobby elevator, it can be quickly implemented without radical modification work on the hoistway of the lobby elevator. In this case also passage from the floors at which the lobby elevator L does not stop to the hoistway S can be simply prevented. When a removable cover b', e.g. a plate, is used, which is decorated according to the surrounding space, people visiting the floor do not think the passageway in question is available for gaining access to the elevator car. For example, if it were desired to change the range of movement of the upper zoned elevator Z,Z' of FIG. 3 a floor downwards, the support structures 3 and 4 below the elevator car of the zoned elevator Z,Z' in question would be shifted the distance of a floor downwards. In this case the lobby floor LF of the figure could be shifted quickly to the lower floor by opening the passageway of the floor in question to the elevator hoistway of the lobby elevator by removing the structure b, which in the figure describes a cover. Behind the cover b' can be a door b, or such a door can be installed only in connection with the opening of the passageway in question. If the access opening is covered with a door b, the door b is preferably locked closed with locking means. In the manner presented above, therefore, the lobby elevator L is preferably formed to comprise access openings, removed from use, between the elevator hoistway and a floor landing.

In the method according to the invention an elevator arrangement that has been in normal passenger traffic use is re-adjusted. The elevator arrangement comprises a plurality of elevators in a building, which plurality comprises a plurality of zoned elevators (Z,Z') in passenger service use moving in an elevator hoistway, which have different ranges of movement of the elevator car in the building to each other with respect to the top limit and/or the bottom limit, and which zoned elevators (Z,Z') each have a top limit and/or a bottom limit of the range of movement of the elevator car, to above the top limit and to below the bottom limit of which range of movement travel of the elevator car of the zoned elevator (Z,Z') in question is prevented. The location, in relation to the building, of the top limit and/or bottom limit of the range of movement of the elevator car of each aforementioned zoned elevator (Z,Z') can be changed in the vertical direction. In the method a zoned elevator Z,Z' that is in use, which has a range of movement that can be changed with respect to the location of the top limit and/or bottom limit, and which is in use to serve passengers and/or to transport freight, is removed from the aforementioned use, after which the range of movement of the elevator car ($C_Z$) of the zoned elevator in question is changed to reach to a different height in the elevator hoistway (S) by changing the vertical location in relation to the building of the top limit and/or the bottom limit of the range of movement of the elevator car ($C_Z$) of the zoned elevator (Z,Z') in question. After this the zoned elevator Z,Z' in question is taken back into the aforementioned use. In this manner the ranges of movement of the plurality of zoned elevators Z,Z' can be changed between the aforementioned removal from the aforementioned use and the taking into use. At the same time the stopping floors of the elevator car of the zoned elevator Z,Z' in question is changed, by adding and/or removing stopping floors. This can be done with some method according to prior art, e.g. by reprogramming the zoned elevator control.

Each zoned elevator Z,Z' of the method can be implemented in practice in one of the manners described in this application, such as in one of the manners presented in FIG. 3 or 7. In the method the elevators are preferably arranged into any of the forms of an elevator arrangement described in this application. In the method the range of movement of a zoned elevator can be changed e.g. with one of the changes between the elevator arrangements of FIGS. 1*a* and 1*b*, or with one of the changes of the elevator arrangements between FIGS. 1*a* and 1*b* (square brackets indicate floors on which modifications have been made). Preferably in the method the elevator arrangement to be re-adjusted comprises a plurality of zoned elevator of the type mentioned, and in the method the range of movement of the elevator car (Cz) of a number of zoned elevators (Z,Z') is changed to reach to a different height in the elevator hoistway (S) in the manner specified above.

Preferably in the method the vertical location of the top limit and/or the bottom limit of the range of movement of the elevator car (Cz) of each zoned elevator (Z,Z') having its range of movement changed is changed by displacing in the vertical direction the means (3,4) determining the location of the top limit/bottom limit of the range of movement, which means (3,4) are detachably supported in their position in the elevator hoistway (S). Thus, for example, in the solution of FIG. 3 the means 4 (preferably support structures) in the proximity of the top end of the range of movement of the elevator car Cz of the zoned elevator Z,Z' can be shifted downwards or upwards for changing the position of the top limit. Correspondingly, the means 3 (preferably support structures) in the proximity of the bottom end of the range of movement of the elevator car Cz can be shifted downwards or upwards for changing the position of the bottom limit. The shifting can be implemented e.g. with an auxiliary hoist (not presented).

A zoned elevator, the range of movement of which is changed, can have a corresponding zoned elevator at least above or below it, the range of movement of which is changed in the manner specified above, in which case the lower of these has a range of movement to be changed at least from the location of the top limit, and the upper of these has a range of movement to be changed at least from the location of the bottom limit, and of these the top limit of the range of movement of the lower zoned elevator and the bottom limit of the upper zoned elevator are changed in the same direction.

In the solution of FIG. 3, immediately above the zoned elevator Z,Z' fully presented in the figure is a second corresponding zoned elevator Z,Z'. Here the upper zoned elevator is very close to the lower one, so that for shifting of the means 3 (here upper support structures) of the lower zoned elevator upwards, the means 4 (here lower support structures) of the upper zoned elevator are also shifted upwards. Corresponding phases can be applied in connection with the solutions of FIG. 7, except that in the solution of FIG. 7*a* in the proximity of the bottom end of the range of movement of the elevator car there are not necessarily any means determining the position of the limit/limits.

Preferably in the method the aforementioned means (3,4), which are preferably support structures of the zoned elevator (Z,Z') in question, are detached from the mounting structures (GR) functioning as a support mounting, above and/or below which mounting structures (GR) are corresponding mounting structures (GR), and the means (3,4) are displaced in the vertical direction and the means (3,4) are fixed again at a different height in the elevator hoistway (S) to the aforementioned corresponding mounting structures (GR) above or below. In FIGS. 3 and 7*d* the mounting structures are marked with dashed lines. Preferably the guide rails (GR) and/or guide rail brackets of a zoned elevator (Z,Z') form the aforementioned mounting structures (GR). In the solutions of FIGS. 7*a*-7*c*, the mounting structures are not presented but the operating principle is preferably similar in relation to the supporting.

In the method the means (3 and/or 4) are displaced a certain distance in the vertical direction, which is preferably a floor-to-floor distance of the building or a multiple of a floor-to-floor distance, in which case the range of movement of the elevator car remains advantageous from the viewpoint of floor-to-floor distances. Preferably a zoned elevator Z,Z' comprises the aforementioned means (3,4) at the top end and/or at the bottom end of its range of movement.

Preferably the elevator arrangement also comprises a lobby elevator (L,L'), the range of movement of the elevator car of which differs from the ranges of movement of the aforementioned zoned elevators (Z, Z'), and the stopping floors of which lobby elevator (L) comprise a plurality of lobby floors (LF), each of which is a stopping floor of one or more zoned elevators (Z,Z') belonging to the aforementioned zoned elevator plurality, and that from the elevator hoistway (S) of the lobby elevator (L) an access opening is arranged to lead to one or more floors, which is not a stopping floor of the lobby elevator (L), which access opening is provided with a door b and/or covered with a removable cover b' (for taking it into use later, more particularly when later the floor in question is changed into a stopping floor of the lobby elevator), and that in the method the aforementioned floor, which is not a stopping floor of the lobby elevator (L), is changed into a stopping floor of the lobby elevator (L) and of a zoned elevator (Z,Z'), in which case preferably

- the aforementioned possible cover b' is removed, or
- the possible locking of the door b is removed, or
- the aforementioned possible cover b' is removed and a door is installed.

The new lobby floor can be a floor, to which a zoned elevator has, with the method described above, been brought to reach. Prefabricated openings leading to the levels of the elevator hoistway ensure rapid convertibility of a lobby elevator. In this way a lobby elevator and a zoned elevator can be quickly brought to have a new common stopping floor, i.e. a new lobby floor.

A zoned elevator Z,Z' can comprise roping 2. The roping can be replaced in connection with changing a range of movement. The need to change a range of movement generally arises rarely (e.g. at intervals of a few years), so in connection with the re-adjustment method also the ropes can be replaced. This is also advantageous because the rope lengths can at the same time be configured to be suited from the viewpoint of the new range of movement. Configuring the rope lengths could alternatively be implemented such that rope is fed into the elevator system or removed from the elevator system according to need, depending on whether the range of movement will increase or decrease. This could be implemented by shifting rope between the rope storage and the elevator system, which rope travels via an openable rope clamp between the rope storage and the elevator system. The rope storage can be in the proximity of the rope clamp of the rope, e.g. in connection with the elevator car in FIG. 3 or 7*a* or 7*b* or 7*c*, or in connection with the support structure in FIG. 7*d*. It is, however, obvious that configuring the rope lengths does not necessarily need to be performed because it is not necessary if, inter alia, the support structures 3 and 4 are both moved the same distance in the same direction in connection with changing the range of movement.

The elevators presented can be installed in a building. The building can be of essentially the height presented, in which case the elevator arrangement specified serves essentially the whole height of the building. In this case preferably the lobby floor of the lobby elevator is the entrance floor of the building. The building could, however, also be taller. The building can comprise other elevators also, e.g. there can be a so-called shuttle elevator or other elevator in the building, which for its part feeds passengers to a lobby elevator L, in which case the floor 1 of FIGS. 1*a*-2*b* can be the stopping floor of such an elevator (not presented). In this case floor 1 can be a so-called skylobby.

Preferably the aforementioned support structures (3,4) are between floor landing openings leading to consecutive floor landings, preferably above the top surface of the opening of the lower opening and below the sill of the opening of the upper opening. In this way the elevator cars of immediately consecutive zoned elevators are able to drive close to each other. Preferably therefore the elevator arrangement according to FIG. 3 comprises two zoned elevators one above the other, of which the bottommost stopping floor of the lower one and the topmost stopping floor of the upper one are consecutive floors. FIGS. 3 and 7*a*, 7*b* and 7*e* also present the advantageous feature that the hoisting machine M of a zoned elevator is connected (with the roping 2) to the elevator car such that the elevator car is able to drive to the extreme position of its range of movement, in which it is at least partly alongside the hoisting machine. In order to achieve this, preferably the motor moving the traction sheave of the hoisting machine M of the zoned elevator is on the side of the vertical projection of the elevator car Cz. In order to achieve this, preferably also the end(s) of the roping 2 are connected to the elevator car Cz to a clamp(s) c on the side of the elevator car, in which case the fixing point is higher than the machine M. In the solutions of FIGS. 3 and 7*a* and 7*b* the clamp c is on the rear side (counterweight side) of the car and in FIG. 7*e* it is on the transverse side. The elevator car in the zoned elevator of FIG. 7*e* is also able to drive to beside the diverting pulley of the bottom end, which diverting pulley is on the side of the projection of the elevator car and guides the roping from the traction sheave of the hoisting machine to the elevator car. The zoned elevators presented could be realized also upside-down with respect to what is presented, in which case the advantages achieved would be corresponding. Also it would be simple to arrange the elevator car of FIG. 7*d* so that the elevator car is able to drive to the extreme position of its range of movement, in which it is at least partly alongside the hoisting machine. For this purpose only the diverting pulley system of the elevator car Cz would need to be displaced to under the car such that the roping 2 passes around the bottom of the elevator car. An advantage of the car Cz being able to drive close to the structure 3,4 is that the elevator cars of immediately consecutive elevators are able to drive close to each other.

In the embodiment of FIGS. 3 and 7*e*, the roping connected to the elevator car comprises a first part 2*a* of suspending roping, which is connected to the elevator car Cz and to the counterweight CW, and supports them while supported by support structures 4 above the elevator car, and additionally, separate to the first part and aforementioned upper support structures 4, a second part 2*b* of the roping and a hoisting machine M in connection with support structures 3 below the elevator car, which hoisting machine M is in power transmission connection via the second part 2*b* with the elevator car Cz and the counterweight CW. In this way the suspension of the elevator, with support structures, can be made simply and the suspending part 2*a* of the roping can be fabricated to be optimal from the viewpoint of dimensioning, manufacturing and material and from the viewpoint of suspension, e.g. to be strong and cheap, and the second part 2*a*, which is therefore the traction part, can be designed to be optimal from the viewpoint of transmitting traction, e.g. to comprise a coating, or a surface shape, that produces good grip on the traction sheave. The driving part 2*b* can comprise e.g. a belt-type rope/ropes and the suspending part 2*a* a round rope/ropes.

The elevator arrangement of FIG. 3 could be alternatively be realized with a solution which is otherwise the same as what is presented, but the elevator car $C_L$ of the lobby elevator is a so-called double-decker car. In this case the elevator car of the lobby elevator L is preferably arranged to stop such that the bottommost stopping floor of the upper zoned elevator is the stopping floor of the upper car floor of the lobby elevator and the topmost stopping floor of the lower zoned elevator is the stopping floor of the lower car floor of the lobby elevator. In this case preferably the topmost stopping floor of the lower zoned elevator and the bottommost stopping floor of the upper zoned elevator are consecutive floors. In this way the stopping frequency of the lobby elevator can be further reduced. Also in the other embodiments the elevator car of the lobby elevator can be formed to be a double-decker.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. An elevator arrangement, comprising:

a plurality of elevators in a building, the plurality of elevators comprising a plurality of zoned elevators in an elevator hoistway, each of the plurality of zoned elevators having an elevator car having different ranges of movement in the building with respect to the other elevator cars of the plurality of zoned elevators, and the plurality of zoned elevators each having a top limit and a bottom limit of the range of movement of the respective elevator car, wherein the respective elevator car is prevented from moving above the top limit and below the bottom limit of the range of movement, wherein a vertical location, in relation to the building, of the top limit and/or the bottom limit of the range of movement of the elevator car of each of the plurality of zoned elevators can be changed, and wherein each zoned elevator comprises vertically movable support structures detachably supported in positions in the elevator hoistway, whereby vertical locations of the support structures in the elevator hoistway determine the location of the top limit/bottom limit of the range of movement of the respective elevator car of each of the plurality of zoned elevators.

2. The elevator arrangement according to claim 1, wherein the support structures comprise a mechanism with which the support structures are detachably supported on mounting structures, wherein the mounting structures include structures of the elevator hoistway itself or structures in the elevator hoistway, and above and/or below the mounting structures are corresponding mounting structures such that the support structures detachably supported on the mounting structures can be detached by operating the mechanism and displaced in the vertical direction and can be attached to the corresponding mounting structures above or below the mounting structures by operating the mechanism.

3. The elevator arrangement according to claim 2, wherein the mounting structures comprise at least one of a guide rail of the elevator, a guide rail bracket, or a wall structure of the elevator hoistway, wherein the mechanism is arranged to directly rest on the at least one of the guide rail of the elevator, the guide rail bracket, or the wall structure of the elevator hoistway.

4. A method for re-adjusting the elevator arrangement according to claim 1, the method comprising the steps of:

removing one of the plurality of zoned elevators from use, which use is to serve passengers and/or to transport freight, hereafter changing the range of movement of the elevator car of the one of the plurality of zoned elevators by changing a vertical location of the top limit and/or the bottom limit of the range of movement of the elevator car of the one of the plurality of the zoned elevators, and thereafter placing the one of the plurality of zoned elevators back into use.

5. The method according to claim 4, wherein the vertical location of the top limit and/or the bottom limit of the range of movement of the elevator car of the one of the plurality of zoned elevators is changed by displacing in a vertical direction structures determining the locations of the top limit/bottom limit of the range of movement, which structures are detachably supported in the elevator hoistway.

6. The method according to claim 5, wherein the structures, which are support structures of the one of the plurality of zoned elevators, are detached from mounting structures, above and/or below which mounting structures are corresponding mounting structures, and the support structures are displaced in the vertical direction and the support structures are attached to the corresponding mounting structures above or below the mounting structures.

7. The method according to claim 6, wherein the mounting structures of the one of the plurality of the zoned elevators are guide rails and/or guide rail brackets.

8. The method according to claim 4, wherein the range of movement for more than one of the elevator cars of the plurality of zoned elevators are changed in the elevator hoistway.

9. The method according to claim 4, wherein the one of the plurality of zoned elevators has a corresponding zoned elevator at least above it or below it, the range of movement of an elevator car corresponding to the one of the plurality of zoned elevators is changed, in which the lower of the one of the plurality of zoned elevators and the corresponding zoned elevator has a range of movement to be changed at least from the location of the top limit, and the upper of the one of the plurality of the zoned elevators and the corresponding zoned elevator has a range of movement to be changed at least from the location of the bottom limit, and the location of the top limit of the range of movement of the lower zoned elevator and the location of the bottom limit of the range of movement of the upper zoned elevator are changed in the same direction.

10. The method according to claim 4, wherein the elevator arrangement further comprises a lobby elevator, the range of movement of the elevator car of the lobby elevator differs from the ranges of movement of the elevator cars of the plurality of zoned elevators, and the stopping floors of the lobby elevator comprise a plurality of lobby floors, each of which is a stopping floor of one or more zoned elevators belonging to the plurality of zoned elevators, and from the elevator hoistway of the lobby elevator an access opening is arranged to lead to one or more floors, which is not a stopping floor of the lobby elevator, which access opening is provided with a door and/or covered with a removable cover, and, in the method, the floor, which is not a stopping floor of the lobby elevator, is changed into a stopping floor of the lobby elevator and of a zoned elevator of the plurality of zoned elevators, wherein the access opening between the elevator hoistway and the floor landing that has been out of use is placed back into use, wherein the removable cover is removed, or the door is unlocked, or the removable cover is removed and the door is installed.

11. The elevator arrangement according to claim 1, wherein the support structures are detachably supported in the elevator hoistway on mounting structures, above and/or below the mounting structures are corresponding mounting structures such that the support structures detachably supported on the mounting structures can be detached from the mounting structures and displaced in the vertical direction and attached to the corresponding mounting structures above or below the mounting structures.

12. The elevator arrangement according to claim 1, wherein the support structures comprise a rope pulley, via which roping connected to the respective elevator car of each of the plurality of zoned elevators travels.

13. The elevator arrangement according to claim 1, wherein the respective elevator car of each of the plurality of zoned elevators is arranged to take vertical support force from the support structures for vertically supporting and/or moving and/or stopping the respective elevator car.

14. An elevator arrangement, comprising:

a plurality of elevators in a building, the plurality of elevators comprising a plurality of zoned elevators in an elevator hoistway, each of the plurality of zoned elevators having an elevator car having different ranges of movement in the building with respect to the other elevator cars of the plurality of zoned elevators, and the plurality of zoned elevators each having a top limit and a bottom limit of the range of movement of the respective elevator car, wherein the respective elevator car is prevented from moving above the top limit and below the bottom limit of the range of movement, wherein a vertical location, in relation to the building, of the top limit and/or the bottom limit of the range of movement of the elevator car of each of the plurality of zoned elevators can be changed, and wherein the elevator arrangement further comprises a lobby elevator, the range of movement of the elevator car of the lobby elevator differs from the ranges of movement of the elevator cars of the zoned elevators, and the stopping floors of the lobby elevator comprise a plurality of lobby floors, each of which is a stopping floor of one or more zoned elevators belonging to the plurality of zoned elevators.

15. The elevator arrangement according to claim 14, wherein the range of movement and the stopping floors of the lobby elevator differ from the ranges of movement and the stopping floors of the zoned elevators such that each zoned elevator has one or more stopping floors, which is not a stopping floor of the lobby elevator.

16. The elevator arrangement according to claim 15, wherein the lobby floors comprise one or more lobby floors, which is the topmost stopping floor of a zoned elevator belonging to the plurality of zoned elevators and/or the bottommost stopping floor of a zoned elevator belonging to the plurality of zoned elevators.

17. The elevator arrangement according to claim 14, wherein movement of the respective elevator cars above the top limit and below the bottom limit of the respective zoned elevator is mechanically prevented.

* * * * *